United States Patent [19]

Clausen

[11] Patent Number: 5,018,323

[45] Date of Patent: May 28, 1991

[54] WALL PANEL SYSTEM

[75] Inventor: Knud Clausen, 6/24 Savannah Street, Epsom, Auckland, New Zealand

[73] Assignees: Knud Clausen; Murray R. Fitzsimmons, both of Epsom, New Zealand

[21] Appl. No.: 520,451

[22] Filed: May 8, 1990

[30] Foreign Application Priority Data

May 12, 1989 [NZ] New Zealand ..... 229095

[51] Int. Cl.[5] ..... A47B 47/00; G09F 7/18

[52] U.S. Cl. ..... 52/36; 52/588; 211/87; 211/189; 248/222.2

[58] Field of Search ..... 52/588, 36, 762, 551; 248/222.2; 211/87, 189

[56] References Cited

U.S. PATENT DOCUMENTS

| | | | |
|---|---|---|---|
| 3,293,819 | 12/1966 | Heirch | 52/588 |
| 3,296,751 | 1/1967 | Heirch | 52/588 |
| 3,412,516 | 11/1968 | Lindstrom | 52/762 |
| 4,450,970 | 5/1984 | Shepherd | 52/36 |
| 4,674,240 | 6/1987 | Strausheim | 52/36 |

FOREIGN PATENT DOCUMENTS

| | | | |
|---|---|---|---|
| 2052594 | 1/1981 | United Kingdom | 52/762 |

*Primary Examiner*—John E. Murtagh

*Attorney, Agent, or Firm*—Young & Thompson

[57] ABSTRACT

In its preferred form the present invention provides a system of interconnecting wall panels, which in normal use provide horizontal parallel recesses along the length of the wall, into which shelf brackets can be fitted, the converse face of the recesses providing detents by which the panels can be attached to a supporting structure on the wall behind.

6 Claims, 2 Drawing Sheets

15
14
16
11
12
13
13
14

18
10
19
17

WALL PANEL SYSTEM

BACKGROUND OF THE INVENTION

The present invention relates to the general field of shelf support systems, with particular application to wall cladding which provides a shelf support system.

Hitherto it has been known to provide wall panel systems which comprise a number of large square or rectangular panels, which are joined at the edges by vertical retaining strips, these retaining strips including a vertical channel or the like into which a shelf bracket can be affixed at any desired height. A problem is often encountered with such systems in that the shelf brackets must be in some way held at a particular position in the channel and be prevented from sliding down it, while still being adjustable as required. Furthermore, installation of such a system can present a number of difficulties. The spacing of the retaining strips is fairly rigidly prescribed by the width of the wall panels, and this spacing may be found inappropriate to a particular wall, taking into account the spacing between corners, and features such as pillars, windows or wall sockets. The two or more shelf brackets supporting any particular shelf must be positioned at the same height in the channel, and this may be difficult or time consuming to achieve. The spacing between channels may be inappropriate to the desired lengths of shelf, and while this problem is less likely to occur if the system uses narrower wall panels, and consequently increases the number of channels available, this solution increases the work required to install the system.

As illustrated by U.S. Pat. No. 4,674,240—M. A. Strausheim 1987, it has been known to go partway towards overcoming these problems with the use of an extruded plastic panel having horizontal channels therein, which are flanged and shaped to retain shelving brackets in normal use. Such a system is however relatively expensive, and is more difficult to install on a wall surface than systems hitherto available. The span of the panel between adjacent channels is very limited, unless the plastic is thickened or otherwise braced in the intermediate zones, and the overall width of each panel is limited by the extrusion process. Furthermore in the system illustrated, a number of panels must be fitted together on "stiffener strips", which must then be attached by undisclosed means to a wall surface. The interconnected panels therefore in practice must be formed into a single large sheet, which presents many of the same installation difficulties as the panels described above.

SUMMARY OF THE INVENTION

It is an object of the present invention to go at least partway towards providing a novel and improved wall panel and shelf support system, or at least to provide the public with a useful choice.

In one aspect the present invention provides a shelf support system including a plurality of elongated wall panels, and a plurality of elongate support elements arranged in normal use transversely relative to said elongate wall panels; wherein each said elongate support element includes a plurality of recesses therein each said recess being undercut in said support element, such that at least one overhanging lip is provided at the mouth of said recess; and each said wall panel is comprised of sheet material folded to provide a first part of a channel along a first edge of said panel, a complementary second part of a channel parallel to said first part, along a second edge opposite said first edge; and a raised face between said parts of a channel; at least one said part including an overhanging lip or flange; whereby a channel can be formed by the association of said first edge of one said panel with said second edge of a second said panel, said channel having at least one overhanging lip or flange; and wherein at least one said part of a channel includes a recurving portion adapted to fit into and engage with said undercut recess; so that in normal use said elongate wall panels can be fastened to said support element by engagement of said at least one part of a channel in a said recess.

Preferably one part of the channel is in the form of an S-bend in cross-section, having two oppositely recurving portions, a first portion forming the overhanging lip or flange, and the second portion being adapted to fit into and engage with the undercut recess.

Preferably the elongate panels are formed from metal.

These and other aspects of the present invention will be made apparent in the following description of a preferred embodiment, given by way of example only.

DESCRIPTION OF THE PREFERRED EMBODIMENT

Figure 1:
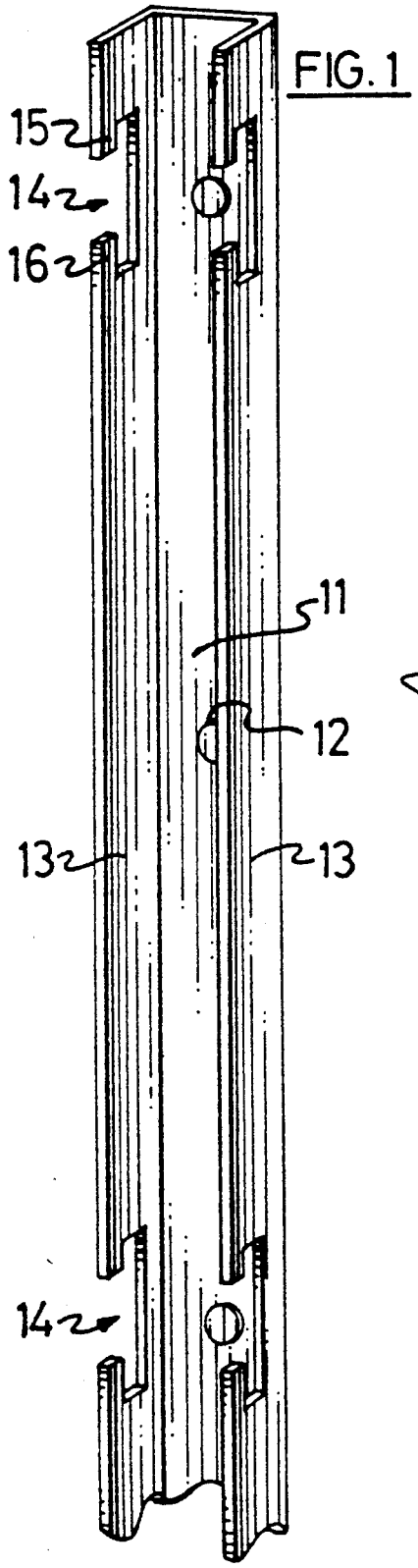
FIG. 1: shows in perspective view a preferred panel support element of the present invention
Figure 2:
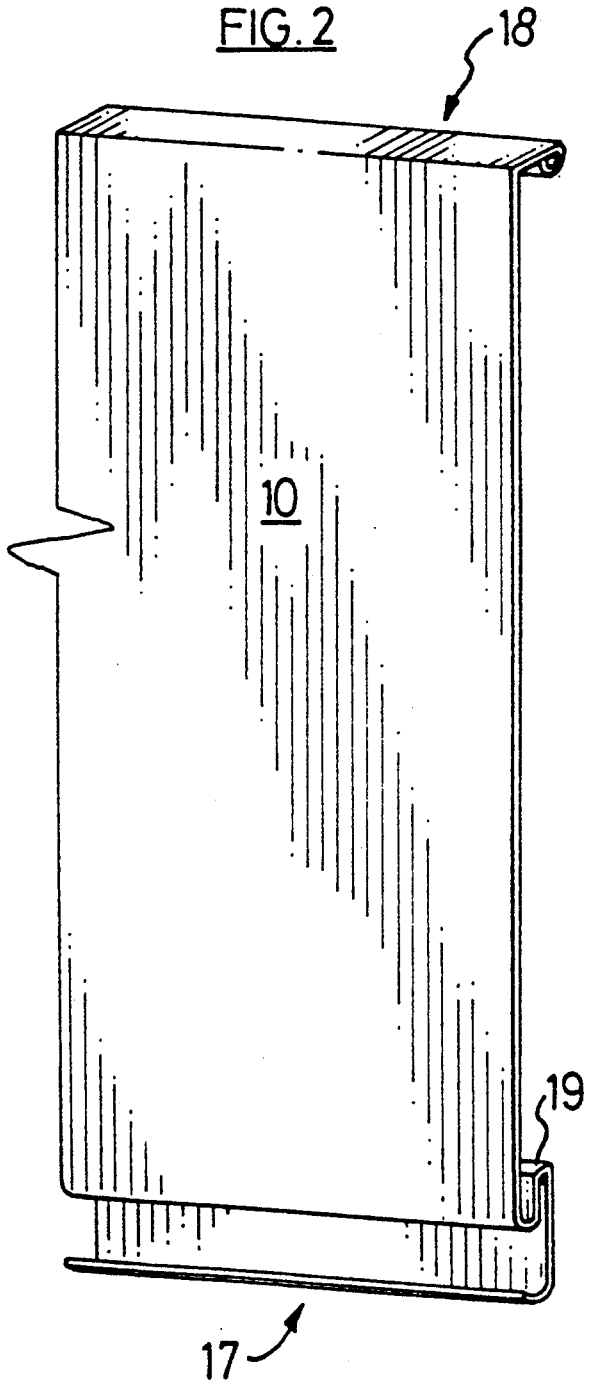
FIG. 2: shows a section of a preferred panel in perspective view.
Figure 3:
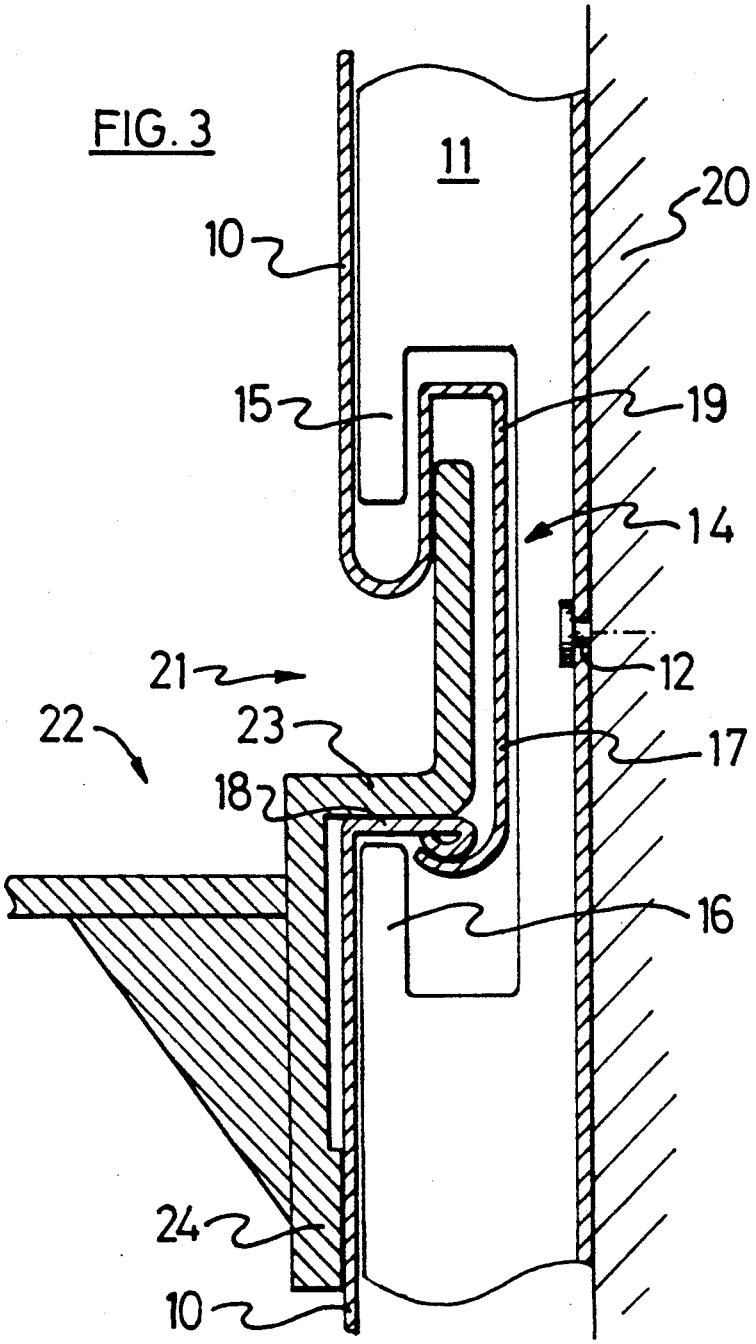
FIG. 3: schematically illustrates preferred panels in conjunction with a support element and shelf brackets, in side view and cross section.

As shown in FIGS. 1 to 3, the present invention in its preferred form provides a system of interconnecting wall panels 10, which provide means for attaching shelf brackets at any of a range of desired heights, and also a substantially any desired horizontal spacing.

As shown in FIG. 1, the present invention provides a system using retaining elements 11 which are in normal use vertically mounted on a wall, onto which elongate horizontally extending panels 10 are fitted. The retaining element 11 in its preferred form comprises a substantially U-section channel member which can be fixed to a wall 20 by nails, screws or the like through apertures 12. The projecting side walls 13 of the retaining element 11 are provided with recesses 14, at regular intervals substantially corresponding to the height of panels 10. Further such recesses 14 might be provided in the element 11, to facilitate use of the retaining element with panels 10 of other heights, or for use with combinations of panels 10 of different heights. The recesses 14 are undercut, to provide projecting lips 15 and 16. The panels 10 preferably comprise roll-formed metal sheets or strips, approximately 15 cm in height, and of any suitable length. It may be found preferable to cut the panels 10 to a desired length as ordered, rather than to provide them in predetermined sizes. It will be appreciated that the height of the panels may be varied considerably. Panels of, for example, 5 cm or 30 cm height might be used, with correspondingly altered retaining elements 11, but it should be appreciated that panels with a greater height will generally provide a lesser ranger of heights at which shelves can be attached, and those of lesser height will be more time consuming to install, as a greater number of panels will be required to cover the same wall area. The height of the panel is preferably selected so that a whole number of panels will make up standard wall heights, to avoid the cutting or trimming of panels to fit the wall.

Each panel is folded on the lower and upper edges to provide co-operating parts of a channel. The lower edge 17 is in the form of an S-bend, so that in normal use as shown in FIG. 3, it hooks under the projecting lip 15 of a recess 14 in the retaining element and turns in behind it, and recurves to form the rear wall of the channel. The lowermost portion hooks behind the other lip 16 of the recess 14, as shown.

The upper edge 18 is bent to form a clip, which in normal use clips over the projecting lip 16 and thereby fastens in place not only the upper edge 18, but also the lower edge 17 of the panel 10 above. Thus, when a wall is to be covered with panels 10, in normal use the top panel will be fitted in place first, and then each subsequent panel fitted in place below it. By this means each panel except the lowermost panel is locked in place by those below.

As shown in FIG. 3, the lower edge 17 of the panel 10 does not extend all the way into the undercut behind the lower projecting lip 16. This space facilitates fitting of the panels onto the retaining element 11. The lower edge 17 is firstly fitted into a recess 14, and pushed downwardly as far as possible into the space behind the lower projecting lip 16. In this position there is sufficient clearance for the recurving portion 19 of the S-bend to pass under the upper projecting lip 16. The recurving portion 19 can then be pushed up behind the lip 15, and the upper edge 18 clipped into another recess 14 above. It should be noted that this system provides a finished channel which has a substantially flat base surface and rear wall, which is relatively easy to clean and will not in normal use tend to trap and collect dust. The upper surface of the channel is undercut to provide a flange with which a shelf bracket can engage.

It will be appreciated that the spacing between the vertical retaining elements 11 is not critical, and as long as at least one retaining element is positioned at or near each end of the panels 10, a stable wall cladding will be formed. Preferably however one or more additionally retaining elements 11 are fixed to the wall at positions between the ends of the panels, to provide additional support.

The channel 21 provided by the co-operating edges of the panels 10 can be used to retain a shelf bracket 22, such as that illustrated in FIG. 3. The shelf bracket 22 includes a hook element 23 which in normal use engages with the channel 21, and a foot 24 which bears against the face of the panel 10. It will be appreciated that a wide variety of brackets could be produced to engage with and be supported by the channel 21 in a similar fashion.

If the retaining elements 11 and wall panels 10 are correctly fitted on the wall 20, shelves can relatively quickly and easily be put in place where desired. Two or more brackets engaged with the same channel 21 will naturally be at the same elevation, and consequently a shelf supported by them will be horizontal. No measurement of heights is required to provide horizontal shelves, or a number of shelves at the same elevation. The horizontal distance between brackets at the same level can be easily adjusted to exactly suit a particular length of shelf.

The use of metal panels 10 can provide fire safety advantages, and allows a wide range of colours and textures to be used. It will be appreciated that the metal panels may be contoured or perforated during the roll forming process, to give desired decorative or acoustic properties. Insulation panels or the like could be mounted behind the panels 10 if required.

Materials other than roll formed metal could be used, although metal panels as described are preferred at present.

It will be appreciated that a variety of other changes and modifications might be made within the scope of the invention, which may be characterised by the following claims.

I claim:

1. A shelf support system including:

a plurality of elongate support elements, a plurality of elongate generally planar wall panels arranged in normal use transversely across said elongate support elements; and a plurality of shelf supports each including a hook or flange;

wherein each said elongated support element includes a plurality of recesses therein, each said recess being undercut in said support element, to provide at least one overhanging lip at the mouth of said recess;

each said wall panel is comprised of sheet material and includes a first part of a channel along a first edge of said panel, a complementary second part of a channel parallel to said first part along a second edge opposite said first edge, and a raised face between said parts of a channel;

at least one said part including to substantially rigid oppositely recurving portions, providing the general form of an S-bend in cross-section, a first portion providing an overhanging flange and the second portion recurving behind the first to provide an undercut channel behind said first portion;

whereby a channel can be formed by the association of said first edge of one said panel with said second edge of a second said panel, said channel having at least one overhanging flange;

wherein the dimensions of said parts of a channel and recesses provide that a said first part of a channel can be fitted into a said recess, extending transversely relative to said elongate support element, and is movable longitudinally relative to said support element within said recess to an engaged position at which said first substantially rigid recurving portion passes around said overhanging lip, and said second substantially rigid recurving portion underlies said overhanging lip, the longitudinal overlap between said lip and said second recurving portion acting to engage said channel in said recess;

further including means engageable to retain said first part of a channel in said engaged position by stopping movement of said panel longitudinally relative to said support element, said means including a transversely projecting flange on said panel, and a coacting detent on said support element;

and wherein said hook or flange of said shelf supports can be engaged in said undercut channel to support a shelf.

2. A shelf support system as claimed in claim 1, wherein said transversely projecting flange, included in said means engageable to retain said first part of a channel in said engaged position, can be arranged to project transversely across at least part of a said recess, and wherein said coating detent comprises a second lip of said recess.

3. A shelf support system as claimed in claim 1, wherein said first part of a channel is continued beyond the second said recurved portion to from a rear face of said channel substantially parallel to the raised face of the panel, and is shaped at the far edge of said rear face to provide a transversely projecting flange to engage with said second part of a channel.

4. A shelf support system as claimed in claim 3, wherein said first part of a channel is at the lower edge of each said wall panel and the first said recurving portion forms a downwardly extending lip or flange, and wherein said complementary second part of a channel is at the upper edge of each said wall panel.

5. A shelf support system as claimed in claim 4, wherein the depth of said recesses in said elongated support elements is not less than the depth of said channel relative to said raised faces of the panels, such that unrecessed portions of the elongate support elements lie adjacent the rear surface of said raised faces of the panels, and act to brace and support said raised faces against denting or buckling.

6. A shelf support system as claimed in claim 1, wherein said elongate panels are formed from sheet metal.

* * * * *